US006474351B1

(12) United States Patent
Cerruti et al.

(10) Patent No.: US 6,474,351 B1
(45) Date of Patent: Nov. 5, 2002

(54) WASHING AGENT DISPENSER, FOR DISHWASHING MACHINES

(75) Inventors: Daniele Cerruti, Fontanetto Po; Costanzo Gadini, Casale Monferrato; Fabio Nebbia, Giarole, all of (IT)

(73) Assignee: Eltek S.p.A., Casale Monferrato (AL) (IT)

( * ) Notice: Subject to any disclaimer, the term of this patent is extended or adjusted under 35 U.S.C. 154(b) by 86 days.

(21) Appl. No.: 09/587,926

(22) Filed: Jun. 6, 2000

(30) Foreign Application Priority Data

Jun. 8, 1999 (IT) ..... TO99A0491

(51) Int. Cl.[7] ..... B08B 3/00; B67D 3/00; A47L 15/44

(52) U.S. Cl. ..... 134/99.2; 134/57 D; 134/93; 134/104.2; 134/114; 68/17 R; 222/109; 222/129; 222/511

(58) Field of Search ..... 134/93, 104.1, 134/104.2, 114, 201, 56 D, 57 D, 58 D, 99.2; 222/109, 129, 511; 68/17 R

(56) References Cited

U.S. PATENT DOCUMENTS 4,974,750 A * 12/1990 Welch ..... 222/129
5,186,912 A * 2/1993 Steindorf et al. ..... 134/93
5,694,794 A * 12/1997 Jerg et al. ..... 134/104.1
5,884,821 A * 3/1999 Wilhelmstaetter et al. .... 134/93
6,401,733 B1 6/2002 Schrott et al. ..... 134/93

FOREIGN PATENT DOCUMENTS

DE 199 24 897 A 12/2000
EP 0 207 520 A 1/1987

* cited by examiner

*Primary Examiner*—Randy Gulakowski
*Assistant Examiner*—Joseph Perrin
(74) *Attorney, Agent, or Firm*—Levine & Mandelbaum

(57) ABSTRACT

A dispensing device of detergents and/or additives for washing machines is described, of the type having at least a space for containing a liquid, such as a rinse aid, the body of the device including at least a first part and a second part, the parts being made integral with each other by welding, wherein a portion of the body is intended to be inserted through an opening of a wall, a surface of the wall facing on a washing tank while the opposite surface of the wall faces on a space which has to be sealed from the tank. According to the invention, a seal is provided, in order to prevent leakage of the liquid from the welding into the space.

43 Claims, 5 Drawing Sheets

WASHING AGENT DISPENSER, FOR DISHWASHING MACHINES

BACKGROUND OF THE INVENTION

The present invention refers to a dispenser of washing agents, in particular for dishwashing machines.

It is known that washing machines usually provide for a dispenser of washing agents, such as detergents and additives; the latter are typically represented, in the case of laundry washing machines, by softening aids, and in the case of dishwashers by rinse aids.

In the case of dishwashers, the dispensers usually have a plastic body, made of two separate pieces welded together; in its front part, the body defines a space for containing a washing agent, usually a detergent, the space being provided with a small closing door, be it of the pivoted or sliding type.

Within the body of the dispenser there is then provided a reservoir for a second liquid washing agent, typically a rinse aid; a suitable metering mechanism provides for the supply of the necessary rinse aid amount from the reservoir towards the washing tank of the machine; it has to be noted that, usually, the rinse aid amount contained in the reservoir is enough for carrying out several washing cycles.

To the rear part of the body, outside it, there are associated one or more electric actuators and one or more kinematic devices, in order that the activation of the actuator(s) causes the opening of the small door of the detergent container and, at a following moment of a washing cycle, the supply of a predetermined amount of rinse aid.

Dispensers of the cited type are usually fastened in in registration with an opening defined on the internal surface of the washing machine door, so that a substantial part of the dispenser body, comprising the electrical and mechanical parts, is embedded inside the door itself; the front part of the dispenser, namely the one having the small door of the detergent containing space and the supplying outlet for the rinse aid, lays outside the opening and the machine's door, directly facing on the inside of the washing tank.

Of course, a gasket is provided between the door opening's edge and the external side of the dispenser body, in order to avoid the anger of water leakage within the door itself, wherein components supplied with electrical voltage are located.

Dispensers for washing agents of the above type can be used also in laundry washing machines, particularly of the top loading type (see for example EP-A-0 628 651).

As already mentioned, the main body of the dispenser is formed in two separate pieces, each one of them obtained usually by means of thermoplastic molding, the two pieces being then welded together in a second time; this in order to allow the arrangement, inside the body, of functional parts, such as some components of the rinse aid measuring system and/or an electric sensor of the level of the rinse aid in the associated reservoir.

According to the prior art, the connecting point, or weld line, between the two pieces which constitute the dispenser body, is located in the part of the body intended to be inserted inside the opening of the door, and is enclosed in the latter.

SUMMARY OF THE INVENTION

The present invention is based on the acknowledgement of the technical problem that the weld points located on the dispenser body represent potentially critical areas of the known dispensers.

In fact it may happen that, as time passes, along the weld between the plastic parts, micro-openings arise, due for instance to the vibration during the machine operation, and/or the mechanical stresses acting on the dispenser during the movements of closing the machine door, and/or the internal pressure of the dispenser due to the expansion in temperature of the rinse aid, and/or other mechanical stresses acting on the device during transportation or manufacturing (as for instance fortuitous falls of the device in the manufacturing line).

It may therefore happen that the micro-openings arise in the rinse aid reservoir, causing leakage of the liquid towards the inside of the machine door; such a fact can cause malfunction or failure of the machine, if the leaking rinse aid, which is electrically conductive, comes into contact with electrical arts inside the door, such as the supply terminals of an actuator of the dispenser, or its electric sensor, or the programming device of the machine itself, which usually is also located inside the machine door.

Furthermore, the rinse aid usually used in dishwashing machines is capable of corroding or otherwise deteriorating some plastic materials, such as the covering of electrical cables and wires; taking account of this fact, a rinse aid leakage inside the door can cause short circuits and potentially dangerous situations for the machine user.

The present invention has the aim of avoiding the above mentioned risks associated with washing agents dispensing devices of the known type.

Further aims, characteristics and advantages of the present invention will be clear from the following detailed description and the attached drawings, which are given as an explanatory and non limiting example only, and wherein:

DESCRIPTION OF THE PRIOR ART

Figure 1:
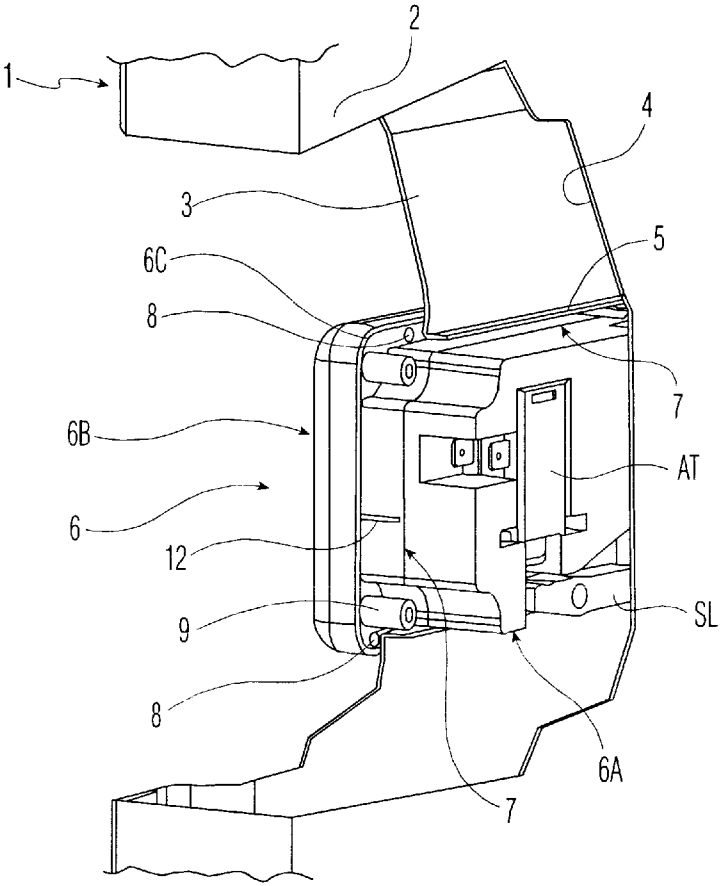
FIG. 1 PRIOR ART
FIG. 1 schematically shows a cross-section of a part of the door of a dishwashing machine, wherein a known type of washing agents dispensing device is inserted.

In FIG. 1, the door of a prior art dishwashing machine has a wall 2 facing toward the outside of the machine, and a wall 3 (or inner door), facing towards the inside of the washing machine tank; between the walls 2 and 3 an interspace 4 is defined wherein components of the machine can be located, like a programming device, with the associated electrical connections, a drying fan, etc.

In the inner door 3 usually made of stainless steel, an opening is defined, the edges of which, indicated with 5 in FIG. 1, are usually folded towards the inside of the interspace 4; in registration with the opening, an electrically controlled washing agents dispenser 6 is fastened.

The dispenser 6 is fabricated according to known technique and therefore will not be described in further detail. It will be sufficient to add that the body of the dispenser 6 is substantially made of two distinct parts, namely a first part 6A, intended to be inserted into the opening defined by the edges 5, and a second part 6B, a portion of which is intended to stay outside of the opening, facing towards the washing machine tank.

The part 6A has on its rear, and, therefore, towards the interspace 4, a generic electric actuator AT and a lever system SL for activating the delivering devices of the dispenser 6 which are of known type, following activation of the actuator AT.

Inside the part 6B, and therefore not visible in the figure, there are defined at least a portion of a reservoir for a liquid rinse aid and, if necessary, a portion of a small cup for a powdered detergent; inside part 6A there are also located the delivery device of the rinse aid and, if necessary, an electronic sensor for detecting the presence thereof; such a sensor may be provided with means for controlling a signaling element located on the command board of the machine for informing the user whether the rinse aid inside the dispenser 6 is exhausted.

The part 6B of the dispenser 6, which has a front portion larger than the part 6A, has on its surface a small door, not visible in the figure, for closing the cup of the detergent, and an outlet, not visible too, for delivering the rinse aid when the associated delivering device is actuated. Part 6A has also an opening/closing device for the small door, which is actuated by means of the actuator AT and the lever system SL, in a known way.

As previously mentioned, the main body of the known dispenser 6 is obtained by welding together the two parts 6A and 6B, the weld or junction line 7 between the two parts being shown in FIG. 1.

As can be seen, the weld 7 is in an intermediate position of the body 6, which normally resides in the interspace 4; as previously mentioned such a disposition may cause problems.

With further reference to FIG. 1, there is shown a gasket 8, disposed between the part 6B and the surface 3A of the inner door 3 facing the washing tank; the function of the gasket 8 is that of preventing liquid or moisture of the washing tank from entering the opening defined by the edges 5, and entering into the interspace 4; for this purpose, the gasket 8 completely surrounds the body of the dispenser 6.

A number of projections 9 protrude from part 6B towards the interior of the interspace 4, and are used, together with one or more brackets, not shown in FIG. 1, for mechanically fastening the dispenser 6 to the inner door 3.

Figure 2:
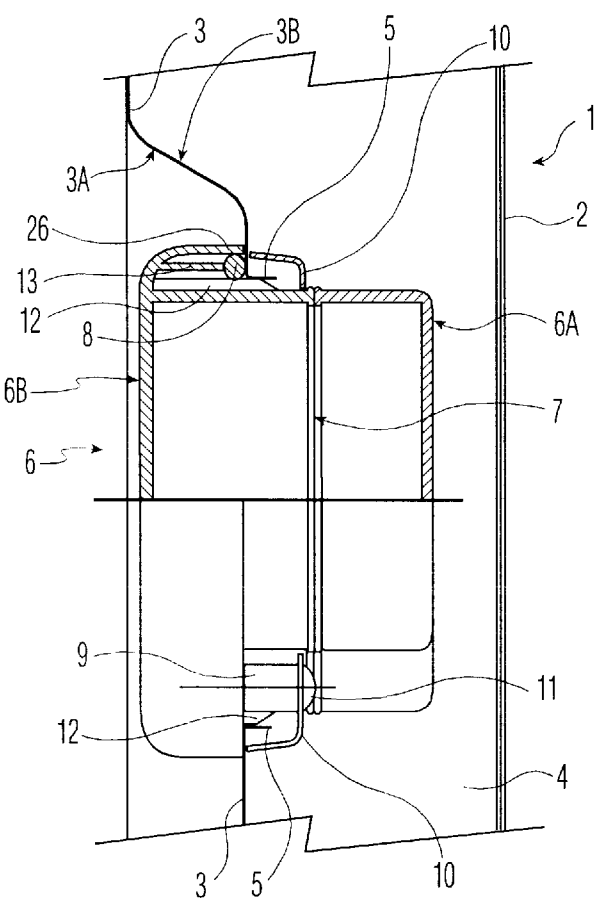
FIG. 2 PRIOR ART
FIG. 2 schematically shows a partial cross-section of a known type of washing agents dispensing device, inserted in a dishwashing machine door.

In FIG. 2, where the same reference numbers of FIG. 1 are used, the fastening system of the dispenser 6 is shown in better detail.

In FIG. 2, there are shown fastening brackets 10 which are secured to the projections 9 by means of screws 11, pressing onto the surface 3B of the inner door facing the interspace 4.

A number of space ribs 12, extend on the lateral surface of the dispenser body from part 6B towards part 6A (one of the ribs 12 can also be seen in FIG. 1).

According to the prior art, the opening of the inner door defined by edges 5 must have a greater size than the portion of the body of he dispenser 6 where the weld 7 is located; the greater size is provided for easing the insertion of the dispenser body into the opening, thereby avoiding possible interference between the edges 5 and the external portion of the weld 7, which may damage the weld. The ribs 12 serve the function of compensating for the above mentioned difference in size between the dispenser body and the opening through which the body is inserted.

The ribs 12, which have inclined ends, are also able to facilitate centering of the part 6B in the opening of the inner door 3, as well as a slight elastic bending of the edges 5.

As can be seen, the circumference of the external surface of part 6B has a wall 6C (FIGS. 1 and 2) able to rest on the surface 3A of the inner door 3; between the wall 6C and the surface of the dispenser 6 on which the ribs 12 are defined, there is defined a continuous rib or support 13 (FIG. 2); such a rib 13 has a shorter length than the wall 6C and constitutes a rest for the gasket 8.

During assembly, the gasket 8 is laid down on the rib or support 13, while the part 6A and a portion of part 6B are inserted into the opening defined by the edges 5; as already mentioned the shape of the ribs 12 facilitates insertion of part 6B into the cited opening, producing a slight bending of the edges 5.

The dispenser body is inserted into the opening until the end of wall 6C comes to rest on the surface 3A of the inner door, on the washing tank side; in this situation the gasket 8 is elastically pressed by the rib 13 on the surface 3A.

At this point, the operator provides for fastening, by means of the screws 11, the brackets 10 on the projections 9, which press on the surface 3B of the inner door; once the electrical connections for the dispenser 6 have been completed, the inner door 3 can be fastened to the remainder of the door 1, after having installed, if necessary, other components (programmer, fan, wiring, etc.) in interspace 4.

As can be seen from FIG. 2, according to the described assembling technique, the weld 7, which fastens together the two parts of the body of the dispenser 6, is located inside the interspace 4; this fact, as already mentioned, may be a source of serious problems, in the case of leakage of rinse aid out of the weld 7.

DESCRIPTION OF THE PREFERRED EMBODIMENT

Figure 3:
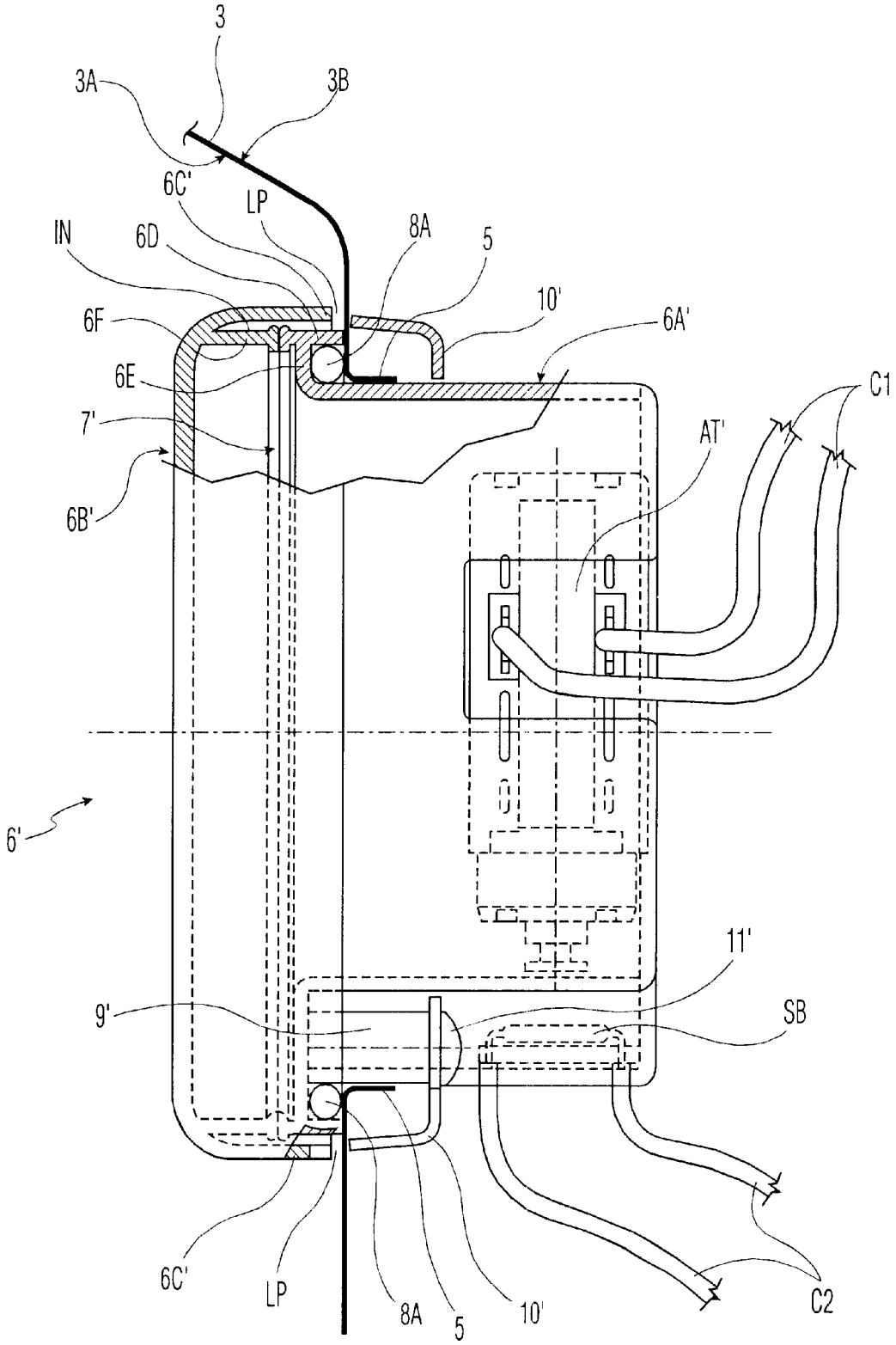
FIGS. 3–11 schematically show partial cross-sections of several preferred embodiments of a washing agents dispensing device according to the invention, inserted in a dishwashing machine door.

In FIG. 3 there is shown a dispenser according to the present invention with the same reference numbers used as in the previous figures, but with the addition of the qualifier "'", for indicating technically equivalent elements.

In FIG. 3, unlike in the previous figures, there is a known rinse aid level sensor SB, having the previously mentioned functions,; and electrical supply and control wires C1 and C2 for the actuator AT' and the sensor SB, respectively.

According to the embodiment of the invention shown in FIG. 3, the weld 7', for fastening together the two parts 6A' and 6B' of the main body of the dispenser 6', is located in the portion of the body which remains outside the door interspace, facing the washing machine tank. To this purpose a suitable sizing of the parts 6A' and 6B' is provided; in particular, in the shown example, the part 6A' has a greater volume than the part 6B' and the latter is completely disposed in the washing tank.

The dispenser 6' need not have the ribs 12 previously described as typical of the prior art. This is possible because, due to the new arrangement of the weld 7', there is no more possibility of interference between the external part of the same weld and the edges 5 of the inner door 3 during the insertion of the part 6A' into the latter. In view of this fact, therefore, according to the invention, the opening made in the inner door can be of a smaller size than that according to the prior art, or, with an equal opening, the body of the dispenser 6' according to the invention can have a greater size than the known dispensers, thereby increasing the capacity for containing washing agents.

As can be seen in FIG. 3, therefore, with the dispenser 6', the edges 5 can directly rest on the flat surface of the part 6A', with a greater contact area between the associated elements (in the case according to the prior art, the edges 5 had a contact only with ribs 12, i.e. with a very limited area of the dispenser body).

Furthermore, in the example of FIG. 3, the sealing gasket, substantially of the O-ring type, now indicated with 8A, is located out side the door interspace, between the weld 7' and the surface 3A of the inner door facing the washing tank, and particularly on the part 6A' near the weld 7'.

The circumferential wall 6C' of the part 6B', unlike in the prior art, does not result in continuous rest or contact with the inner door surface, so that between the two elements a gap is defined, indicated in FIG. 3 with LP.

The rest of the dispenser 6' body on the surface 3A of the inner door 3 is now effected by means of a wall 6D, being internal with respect to the wall 6C', and which is a part of 6A'; as can be seen, the wall 6D extends substantially parallel o the wall 6C' and the external surface of the part A'; wall 6D is practically an extension of the internal wall 6F of the part 6B'.

According to the given example, therefore, a housing for the gasket 8A is defined, which is delimited:

by a portion of the wall 6D;

by the extension, towards the washing tank, of the external surface of the part 6A';

by a further connecting wall, indicated with 6E, which extends between the wall 6D and the cited extension of the external surface of the part 6A' in a perpendicular direction in respect of them (practically, the wall 6E too is an extension, perpendicular to the surface of the part 6A', extending externally of the door interspace on the washing tank side).

It should be pointed out that, in this way, the gasket 8A is completely in contact with at least one of the sides defining its housing, and therefore, besides the inner door 3, also with the external surface of part 6A', and/or the wall 6D, and/or the wall 6E, with evident advantages as to sealing.

The arrangement according to the embodiment of FIG. 3 solves the above mentioned problems of the prior art.

In fact, according to the invention, a possible leakage of rinse aid, due to micro-fractures of the weld 7', is directed outside the interspace of the machine door.

It is clear, in fact, that the leaking rinse aid can only flow into the interstice IN defined between the wall 6C' and the walls 6D–6F; furthermore, due to the presence of the gap LP, the leak will be directed to fall downwards, outside the interstice IN and directly into the washing tank, along the external surface 3A of the inner door 3; in this way an accumulation of rinse aid in the area of the dispenser 6' is avoided.

The removal of the rinse aid leakage from the area of the dispenser 6' will also be aided by the liquid present within the washing tank which, during the operating phases of the machine, can enter through the gap LP thereby washing away the rinse aid from the interstice IN; the interstice can, if necessary, be conveniently shaped in order to facilitate the washing, or may also be eliminated in order to avoid any possible accumulation of water and rinse aid.

The presence of wall 6D also reduces the possibility of contact between the rinse aid spilling from the weld 7' and the gasket 8A; it is in fact clear that, due to the presence of the continuous wall shielding the gasket 8A in respect of the weld 7', the leaking rinse aid is unlikely to come into contact with the gasket; this because the gaps, due to manufacturing tolerances, which exist between the end of the wall 6D and the surface 3A of the inner door 3, are of very small size, and the leaking rinse aid, usually very dense, will have great difficulty in entering through the gaps. In any case, the possibility is practically avoided thanks to the above mentioned continuous washing of the interstice IN.

Finally, as already mentioned, any possible interference between the weld 71 and the edges 5 of the opening in the inner door 3 is avoided.

It should be mentioned that, in place of the continuous gap LP along all the length of the end of the wall 6C', a kind of crenellation could be provided, namely a number of scattered openings, in order to allow the passage of the rinse aid leakage and the washing liquid for taking it away.

In FIGS. 4–11 there are shown further possible alternate embodiments of the present invention; also in the figures the same reference numbers will be used as in the previous figures, for indicating technically equivalent elements, with the possible addition of the qualifier "'".

Figure 4:
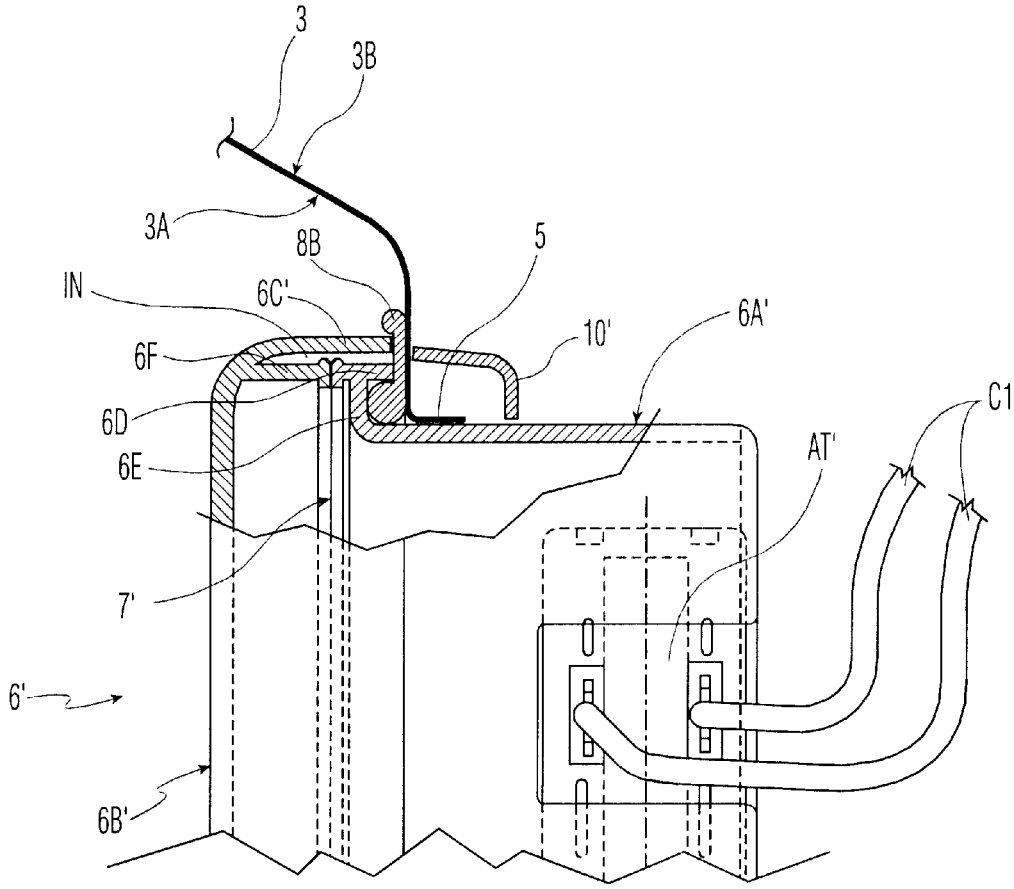

For instance, FIG. 4 shows an embodiment of the invention which is substantially similar to that of FIG. 3, wherein the weld 7' between the parts 6A' and 6B' is located externally of the interspace of the machine door.

In this example, a gasket 8B is provided, having a generally elongated shape, to obtain a first seal between the end of the wall 6D and the surface 3A of the inner door 3, and a second seal between the end of the wall 6C' and the surface 3A of the inner door 3; in other words, therefore, the gasket 8B achieves a double leak-resistance, both for the part 6A' and the part 6B' with respect to the washing tank.

Such an arrangement of gasket 8A can be useful in order to obtain, besides an improved seal against penetration of liquid towards the door interspace, compensation for possibly excessive stresses on the weld 7' during the tightening of the brackets 10'.

It should be noted that, in this variant, the interstice IN between the walls 6C' and 6D–6F need not necessarily be watertight; to this purpose, in fact, the wall 6C' could include passages able to perform the function of the gap LP of FIG. 3.

Figure 5:
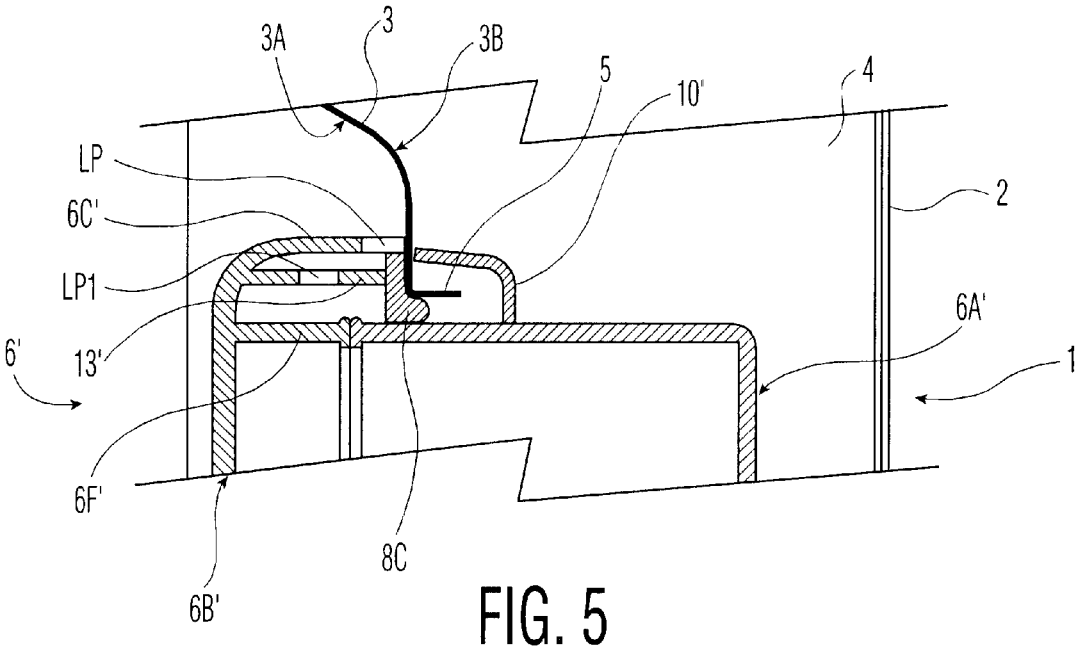

Also in the case of the embodiment of FIG. 5, the weld 7' between the parts 6A and 6B' is located externally of the interspace 4 of the machine door.

Unlike the previous figures, in this case there is not an enclosed housing for the sealing element, and the wall 6F' of the part 6B' is now an extension of the external surface of part 6A'; as can be seen, furthermore, between wall 6F' and wall 6C' there is a continuous rib 13'; such a rib 13' has suitable passages, indicated with LP1.

In this case, a gasket 8C is provided, having substantially an "L" shape, for achieving a seal between the external surface of part 6A' and the edges 5, and a compensation rest between the end of rib 13' and the inner door 3; also in this case the sealing element represented by the gasket 8C is in contact with both the inner door 3 and the parts 6A' and 6B of the body of the dispenser 6'.

The rinse aid leaking from the weld 7' can reach the washing tank through the passages LP1 and the gap LP; a part of the water circulating in the washing tank can cover the inverse path, through the gap LP and the passage LP1, thereby removing residues of rinse aid from the area of the dispenser 6'.

Figure 6:
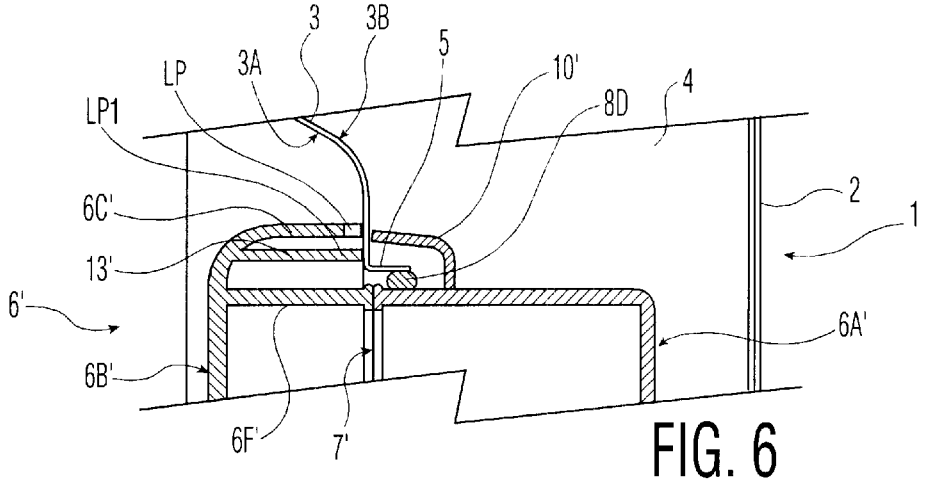
Figure 7:
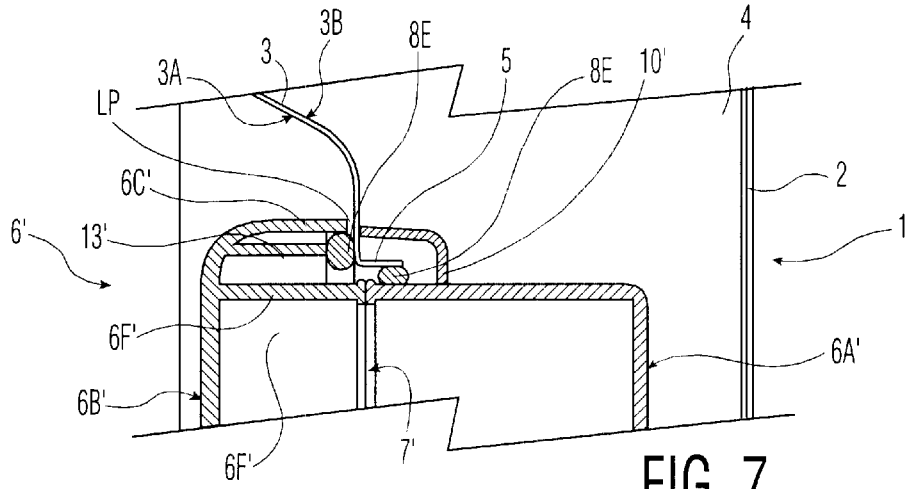
Figure 8:
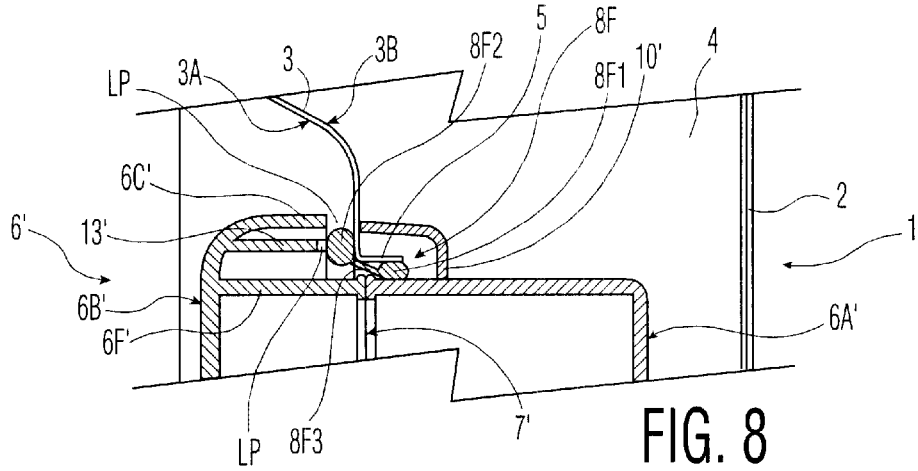

FIGS. 6, 7 and 8 show embodiments of the invention wherein the weld 7' is located substantially in an intermediate position between the washing tank and the interspace of the machine door.

For instance, in FIG. 6 the weld 7' extends near the plane where there is defined the opening in the inner door 3, for receiving the dispenser 6'.

In this case, a casket 8D of the O-ring type is provided, sealing between the surface of the folded edges 5 of the inner door 3 and the external surface of part 6A' of the body of the dispenser 6'; as can be seen, therefore, there are provided sealing means 8D, for preventing the possibility that rinse aid leakage from the weld 7' will enter the interspace 4.

As can also be seen, in FIG. 6, the wall 6C' and the rib 13' are provided with suitable passages LP and LP1, in order to avoid both the accumulation of rinse aid in the area of the dispenser 6' and allow the elimination of the residues thereof by means of the washing water circulating in the tank.

Preferably, on the external surface of part 6A' there can be defined a suitable seat, not shown in the figure for the sake of simplicity, for precisely positioning gasket 8D.

The embodiment shown in FIG. 7 is substantially similar to that of FIG. 6, with the difference that, in addition to the gasket 8D, there is provided a further gasket 8E, in order to obtain a sealing action and/or compensation for possibly excessive stresses on the weld 7' at the moment of the fastening of the brackets 10'.

In this case, there are provided two distinct sealing elements, 8D and 8E, of the O-ring type, which respectively achieve a seal between the surface 3A' of the inner door 3 and the part 6A', and a seal between the surface 3A' of the inner door 3 and the part 6B'.

The gasket 8E could be interrupted in one or more points, in order to allow the draining of the leaking rinse aid and its washing water circulating in the tank.

The embodiment of FIG. 8 is substantially similar to that of FIG. 7, with the difference that, in this case, there is provided a single sealing element 8F, made up of two sealing rings 8F1 and 8F2, substantially of the O-ring type, which perform respectively the functions of the separate gaskets 8D an 8E of FIG. 7, and are connected together by means of an elastic continuous membrane 8F3; during operation, the membrane is stretched between the rings 8F1 and 8F2 and can direct the leaking rinse aid towards the passages LP and LP1, so that it can reach the washing tank.

Figure 9:
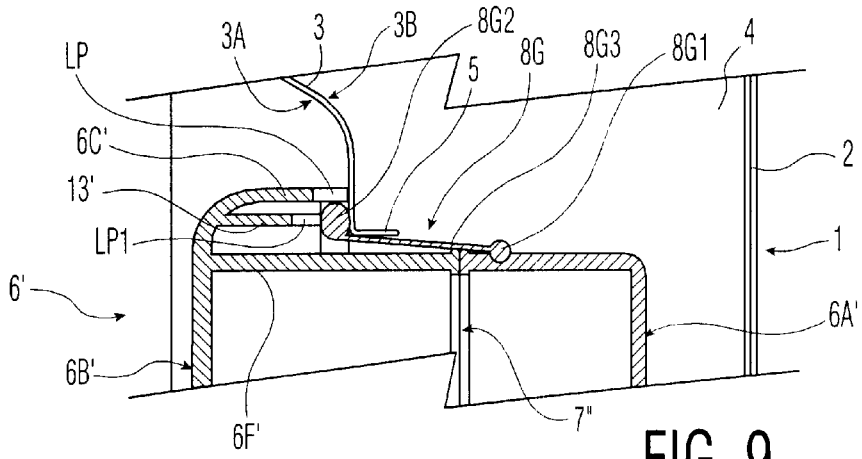
Figure 10:
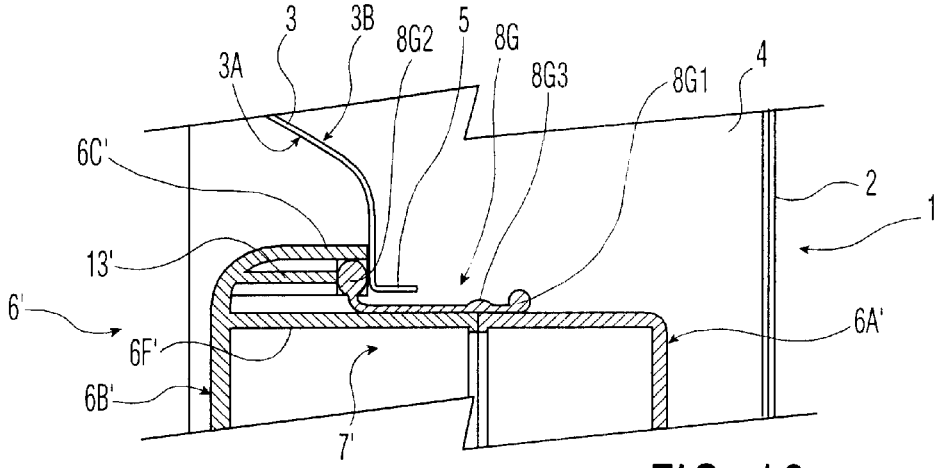
Figure 11:
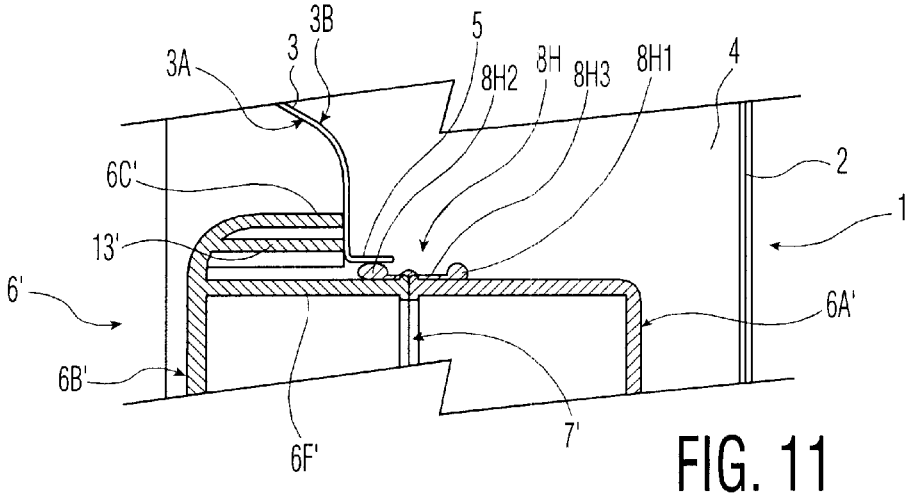

FIGS. 9, 10 and 11 show embodiments of the dispenser according to the invention, wherein the weld between parts 6A' and 6B', now indicated with 7", results in being located inside the interspace 4 of the door 1, but there are provided suitable means to prevent the passage of leaking rinse aid from the weld 7" towards the interspace; The brackets 10' are not shown for the sake of simplicity.

In the case of FIG. 9, the dispenser according to the invention is provided with a sealing element 8G, made up of two elastic rings 8G1 and 8G2, substantially of the O-ring type, connected together by means of an elastic membrane 8G3.

As can be seen, the ring 8G1 is located inside the interspace 4, on the surface of part 6A', which for this reason is provided with a suitable positioning seat; the ring 8G1 keeps its position due to its elasticity; this can be obtained where the ring 8G1 has a length which is shorter than the perimeter of part 6A' whereon the same ring is disposed.

The ring 8G2 on the contrary is located outside of the interspace 4 and is kept on the surface 3A of the inner door 3 by a rib 13'; in this case both the rib 13' and the wall 6C' are provided with suitable gaps or passages LP and LP1.

The ring 8G2 performs the function of sealing on surface 3A, in order to avoid penetration of water from the tank towards the interspace 4, and a compensation action against excessive stresses on the weld 7" at the moment of fastening of the bracket of the dispenser.

The function of preventing rinse aid leakage from the weld into the in is performed by the membrane 8G3, which is stretched between the rings 8G1 and 8G2.

The leakage of rinse aid from the weld 7", in fact, is conveyed by the membrane 8G3 towards the outside of the door interspace 4, and is free to exit towards the washing tank through the passages LP and LP1; due to the passages, moreover, a part of the water circulating in the washing tank can remove possible residues of rinse aid from the area of the dispenser 6'. The membrane 8G3 and the rings 8G1 and 8G2 also prevent the water circulating in the tank from reaching the interspace 4.

The embodiment shown in FIG. 10 is similar to that of FIG. 9; in this case there is provided a sealing element 8G whose membrane 8G3, instead of being stretched between the rings 8G1 and 8G2, provides a seal on the surface of the dispenser 6'.

As can be seen, the ring 8G1 is located inside the interspace 4, on the surface of part 6A', which may be provided with a suitable positioning seat, not shown in the figure; the ring 8G2, which performs the sealing function against water penetration from the washing tank of the machine, operates on the surface 3A being located outside of the interspace 4, and is kept in compression on the surface 3A of the inner door by a rib 13'. The ring 8G2 in this embodiment, also performs a compensation action against possibly excessive stresses on the weld 7", at the moment of fastening of the brackets of the dispenser.

In this case, the function of keeping the leakage of rinse aid from the weld 7" is performed by the membrane 8G3, which connects the two rings 8G1 and 8G2, and provides for covering and sealing the weld itself and the adjacent areas of the dispenser body.

Also in this case, the ring 8G1 and at least a substantial part of the membrane 8G3 can be maintained in their respective operating positions thanks to the elasticity typical of their material, as already mentioned; as an alternative, the membrane 8G3 may be made integral with the surface of dispenser body at least at two points, respectively located on the parts 6A' and 6B', e.g. by means of gluing or thermal-welding.

In this way, therefore, the rinse aid leaking out of the weld 7" is blocked by the membrane 8G3 and cannot reach into the door interspace 4.

In the case of the embodiments of FIGS. 9 and 10, the dispenser according to the invention can be provided with ribs, not shown, having the function of the ribs 12 in FIGS. 1 and 2; the membrane 8G3, which connects the two gaskets or perimetrical rings 8G1 and 8G2, could have suitable thickness and shape for replacing the ribs, while still allowing the liquid to flow into the tank (e.g. through suitable passages) and/or to ensure a radial sealing on the dispenser surface.

In view of this act, for instance, the elastic element connecting the rings 8G1 and 8G2 could have a substantially cuneiform shape.

Finally, in the embodiment of FIG. 11 there is shown the case of a sealing element 8H, having two rings 8H1 and 8H2 of the O-ring type, respectively in contact with the surfaces of part 6A' and 6B' of the body of the dispenser 6'; the rings 8H1 and 8H2 are located on the sides of the weld 7" and connected together by an elastic membrane 8H3, which performs the function of holding leakage of rinse aid out of the weld.

As can be seen, the ring 8H2 is in this case interposed between the surface of part 6B' and the edges 5, in order to avoid penetration of water from the washing tank inside of interspace 4; the ring 8H1 remains in sealing engagement with the surface of part 6A', by virtue of its elasticity.

Also in this case, therefore, the rinse aid leaking out of the weld 7" is blocked by the membrane 8H3 and cannot consequently reach the door interspace 4.

In the case of solutions employing two leak-prevention elements (either separate, as in the case of FIG. 7, or connected together by a membrane, as in the case of FIG. 11), the sealing element which operates on the part 6A' shall be designed or sized in order to obtain a sealing of stronger pressure or intensity with respect to the sealing element which cooperates with part 6B'. For instance, referring to FIG. 7, this can be obtained by providing the ring 8E with a softer or more elastic material than the ring 8F. Analogously, for instance in the case of FIG. 10 or 11, the rings 8G1 or 8H1 and the membranes 8G3 or 8H3 can have a high radial strength and/or be made at least in part directly integral with the surface of part 6A' (by means of gluing, thermal welding or molding), while the rings 8G2 or 8H2 can be simply interposed between the surface of part 6B' and the edges 5.

Such a provision can be made in order to avoid possible expansion, due to temperature, of the leaking rinse aid being collected between the two rings, which may cause problems with or damage to the sealing system according to the invention, or penetration of the rinse aid itself inside of the interspace 4.

Referring to the just cited figures and according to the proposed solution, rinse aid spilled due to expansion which can overcome the sealing capacity of the ring 8E or 8G2 or 8H2 and/or of the membrane 8G3 or 8H3, will find an outlet only towards the washing tank, and not towards the interspace 4.

A dispensing device has been described, for detergents and/or additives for washing machines, having at least a container of a liquid, such as a rinse aid, wherein the body of the device includes at least a first part 6A' and a second part 6B', made integral to each other by means of a weld 7 or 7"; a portion of the body made up of the two parts 6A' and 6B' is intended to be inserted through an opening 5 formed in a wall 3, a surface of which faces a washing tank, the opposite wall facing towards a space 4, which shall be tightly insulated in respect of the tank.

According to the invention, insulating means are provided, for preventing leakage of the liquid from the weld 7 and 7" to the inside of the space 4 and/or for conveying the leakage towards the washing tank.

In some embodiment of the invention, the insulating means are formed by means of a suitable sizing and positioning of use of the two parts 6A' and 6B'.

It is clear that variations are possible for the man skilled in the art of washing agent dispensers according to the invention described by way of example, without departing from the novelty or scope of the invention.

For instance, it is evident that washing agent dispensers according to the present invention can be used also in laundry washing machines, in particular of the top loading type.

Equally, the dispenser according to the invention, instead of being fastened to the inner door of a dishwasher, could be generally fastened to any of the walls or surfaces defining the washing tank.

The shape of the various sealing elements could be different from the one described above; for instance, the various rings, instead of being of the O-ring type, could have a rectangular cross section (Square-ring).

Previously, reference has been made to the possibility of obtaining the necessary sealing of the rings 8G1 and/or 8H1 by exploiting the elasticity of their material, and choosing the length of the rings to be smaller than the length of the perimeter of part 6A'. In alternative versions, the rings could be made integral to part 6A' by means of gluing, thermal welding, molding, etc.

The seal for preventing the passage of leaking rinse aid towards the inside of the interspace 4 could be of conception and realization other than as shown. For instance, on the external surface of the dispenser body, in particular in areas adjacent to the weld between the two parts, suitable seats could be provided, wherein, during manufacturing, a material in the liquid state could be poured, which, due to its subsequent hardening, will then become the seal.

What is claimed is:

1. Apparatus for dispensing detergents and other additives into a washing machine tank, said apparatus for dispensing comprising a body having a first part and a second part, said parts being joined at a weld, a portion of said body being adapted to be inserted through an opening in a wall having a surface of said wall facing into a washing tank and an opposite surface facing into a space sealed from said tank, and sealing means are mounted on said body for diverting leakage of liquid from said weld away from said space and into said washing tank.

2. Apparatus, according to claim 1, wherein a portion of said first part is adapted for insertion into said space and a portion of said second part is adapted to be disposed within said washing tank.

3. Apparatus, according to claim 2, wherein said sealing means is in engagement with a surface of said first part.

4. Apparatus, according to claim 1, wherein at least a first portion of said first part is adapted to be contained within said space and a second portion of said first part is adapted to be disposed in said washing tank.

5. Apparatus, according to claim 4, wherein said sealing means is in engagement with a surface of said second portion of said first part.

6. Apparatus, according to claim 1, wherein said sealing means is in engagement with said wall.

7. Apparatus, according to claim 1, wherein said sealing means is in engagement with a surface of said second part.

8. Apparatus, according to claim 1, wherein said sealing means is in engagement with a surface of said first part and said wall.

9. Apparatus, according to claim 1, wherein said sealing means is in engagement with a surface of said first part and a surface of said second part.

10. Apparatus, according to claim 1, wherein said weld is in an area of said body which is not inserted in said opening, said area being located outside of said space.

11. Apparatus, according to claim 1, wherein said sealing means engages said first part and second part, said first part being of greater volume than said second part.

12. Apparatus, according claim 1, wherein said sealing means is actuated by the positioning of said second part completely outside of said space and in said washing tank.

13. Apparatus, according to claim 1, wherein said first part has a flat surface adapted to be engaged by an edge of said wall opening.

14. Apparatus, according to claim 1, wherein a portion of said sealing means is disposed in a plane intermediate said weld and said wall when said portion of said body is inserted through said wall opening.

15. Apparatus, according to claim 1, wherein said second part comprises an external surrounding wall.

16. Apparatus, according to claim 15, wherein said external surrounding wall has a passage gap.

17. Apparatus, according to claim 16, wherein said passage gap allows a rinse aid leaking out of said weld to flow towards said washing tank, and allows a part of the liquid circulating in said washing tank to remove residues of said rinse aid.

18. Apparatus, according to claim 1, wherein said first part has a rest area on the surface of said wall facing the washing tank.

19. Apparatus, according to claim 1, wherein a housing for said sealing means comprises one surface of said first part and said wall.

20. Apparatus, according to claim 1, wherein said second part comprises a support to keep said sealing means in contact with said wall.

21. Apparatus, according to claim 20, wherein said support comprises a passage gap.

22. Apparatus, according to claim 1, wherein said sealing means are in contact with said first part, said second part and said wall.

23. Apparatus, according to claim 22, wherein said sealing means comprise means for achieving a first seal between said second part and said wall, and a second seal between said first part and said wall.

24. Apparatus, according claim 1, wherein said sealing means comprises means for absorbing excessive stresses on said weld during fastening of said dispenser.

25. Apparatus, according to claim 1, wherein said sealing means comprise:

a first seal between a surface of said first part and the edges of said opening defined in said wall, which are folded towards the inside of said space; and a second seal, between said wall and a surface of said second part.

26. Apparatus, according to claim 1, wherein said weld is located substantially intermediate said washing tank and said space.

27. Apparatus, according to claim 26, wherein said sealing means operate between a surface of said first part and the edges of said opening defined in said wall, which are folded towards the inside of said space.

28. Apparatus, according to claim 27, wherein said sealing means comprise a first sealing element, disposed between said first part and said wall, and a second elastic element, disposed between said second part and said wall.

29. Apparatus, according to claim 1, wherein said weld is within said space.

30. Apparatus, according to claim 1, wherein said sealing means comprise two peripheral sealing elements and an intermediate sealing element connected therebetween.

31. Apparatus, according to claim 30, wherein said peripheral sealing elements comprise rings.

32. Apparatus, according to claim 30, wherein said intermediate sealing element comprises an elastic membrane.

33. Apparatus, according to claim 30, wherein said intermediate sealing element is adapted to compensate for the size difference between said first part and said opening.

34. Apparatus, according to claim 30, wherein said intermediate sealing element is adapted to produce a slight elastic flexion of edges of said opening.

35. Apparatus, according to claim 30, wherein said intermediate sealing element has a substantially cuneiform shape.

36. Apparatus, according to claim 30, wherein one of said peripheral sealing elements is located within said space and the other of said peripheral sealing elements is located outside said space and in said washing tank.

37. Apparatus, according to claim 36, wherein said intermediate sealing element is arranged between said two peripheral sealing elements for conveying the rinse aid leaking out of said weld towards the outside of said space, into said washing tank.

38. Apparatus, according to claim 36, wherein said intermediate sealing element is arranged for covering said weld and areas of at least one of said first part and said second part adjacent to said weld, in order to collect the rinse aid leaking out of said weld.

39. Apparatus, according to claim 30, wherein a surface of said body comprises a positioning seat for one of said peripheral sealing elements.

40. Apparatus, according to claim 30, wherein at least one of said sealing elements comprises an elastic material.

41. Apparatus, according to claim 30, wherein one of said peripheral sealing elements is integral with one of said first and second parts.

42. Apparatus, according to claim 30, wherein one of said peripheral sealing elements is between said wall and a surface of said second part.

43. Apparatus, according to claim 1, wherein said body comprises a mold for forming said sealing means from a liquid which solidifies after being poured thereinto.

* * * * *